US006110305A

United States Patent [19]

Nishimura et al.

[11] Patent Number: 6,110,305

[45] Date of Patent: Aug. 29, 2000

[54] METHOD FOR PRODUCTION OF HIGH-STRENGTH LOW-EXPANSION CAST IRON

[75] Inventors: Takanobu Nishimura, Chigasaki; Motoo Suzuki, Mie-ken; Hisato Kamohara, Yokohama, all of Japan

[73] Assignee: Kabushiki Kaisha Toshiba, Kawasaki, Japan

[21] Appl. No.: 08/448,524

[22] PCT Filed: Dec. 15, 1993

[86] PCT No.: PCT/JP93/01819

§ 371 Date: Jun. 14, 1995

§ 102(e) Date: Jun. 14, 1995

[30] Foreign Application Priority Data

Dec. 15, 1992 [JP] Japan ..... 4/353969

[51] Int. Cl.[7] ..... C21D 10/00

[52] U.S. Cl. ..... 148/540; 148/543

[58] Field of Search ..... 420/10; 148/540, 148/543, 324, 336, 321

[56] References Cited

U.S. PATENT DOCUMENTS 5,264,050 11/1993 Nakashima et al. ..... 148/336

FOREIGN PATENT DOCUMENTS 57-149449 9/1982 Japan .
61-177356 8/1986 Japan .
61-219566 9/1986 Japan .
62-205244 9/1987 Japan .
62-224573 10/1987 Japan .
62-268249 11/1987 Japan .
63-433 1/1988 Japan .
63-48875 3/1988 Japan .
63-48876 3/1988 Japan .
63-60255 3/1988 Japan .
63-93840 4/1988 Japan .
64-55364 3/1989 Japan .
1-159171 6/1989 Japan .
1-36548 8/1989 Japan .
2-70040 3/1990 Japan .
2-298236 12/1990 Japan .
4-136136 5/1992 Japan .
WO850962 5/1985 WIPO ..... 148/323

*Primary Examiner*—Deborah Yee
*Attorney, Agent, or Firm*—Finnegan, Henderson, Farabow, Garret & Dunner, L.L.P.

[57] ABSTRACT

A method is proposed for the production of high-strength low-expansion cast iron enabled to acquire improved strength, hardness, and cutting workability while retaining the property of low expansion intact. The product is a low-expansion cast iron having a high nickel content and exhibiting a coefficient of thermal expansion of not more than $8\times10^{-6}/°$ C. at temperatures in the range of from room temperature to 100° C. By causing a carbide to be finely precipitated in an area ratio in the range of from 0.3% to 20% in the metal structure of the cast iron and lowering the C content in the cast iron, there is produced a high-strength low-expansion cast iron. The deposition of the carbide mentioned above is accomplished by incorporating in the material for cast iron at least one element selected from the group consisting of the transition metal elements of IVa, Va, and VIa Groups in the Periodic Table of the Elements.

35 Claims, 6 Drawing Sheets

METHOD FOR PRODUCTION OF HIGH-STRENGTH LOW-EXPANSION CAST IRON

TECHNICAL FIELD

This invention concerns a low-expansion cast iron having a high Ni content and relates to a method for the production of a high-strength low-expansion cast iron which is allowed to acquire exalted strength without a sacrifice of the low-expansion property inherent therein.

BACKGROUND ART

As known to date, cast iron has been in popular use as the basic material for industry. This is because the cast iron has such advantages as excelling in castability, allowing formation of multiple kinds of complicatedly shaped articles, readily yielding to cutting and similar machining works, incurring rather low expenses in procurement of raw materials and execution of melting work, and enjoying ease of manufacture even at a factory of a small scale.

Recently, the electronic industry and the optical industry have advanced to a point where the machine tool, measuring devices, molding dies, and other manufacturing machines which are associated with these industries demand materials of increasingly high accuracy and function. For the purpose of answering this demand, the necessity for materials which are capable of lowering thermal expansion coefficient and repressing thermal deformation to the fullest possible extent besides keeping the characteristic properties of the conventional materials intact is growing all the more in profundity. As metallic materials of low thermal expansion coefficients, an about 36%Ni—Fe alloy (Invar alloy) and an about 30%Ni—5%Co—Fe alloy (Super Invar alloy) which are shown in Table 1-1 and Table 1-2 are known. They have not yet been fully tamed for the utmost use. This is because they are unfortunately deficient in cutting workability, and castability. In recent years, the materials which are obtained by treating the Invar and the Super Invar alloy so as to impart the quality of cast iron thereto and vest them with improved cutting workability and enhanced castability and which, therefore, are relieved of the drawback mentioned above have been attracting growing attention. Table 1-1 and Table 1-2 also show the low-expansion cast iron which has been known as Niresist D5 for a long time, Nobinite cast iron as one example of the low-expansion cast irons developed in the last several years, and the cast iron disclosed in JP-A-62-268,249.

The materials shown in Table 1-1 and Table 1-2, however, are either alloys which have not induced separation of graphite by crystallization or nodular graphite cast irons and mainly have an austenitic structure as a base matrix and, therefore, have tensile strength in the range of from 40 to 55 kgf/mm$^2$ and Brinell hardness in the neighborhood of HB 120. Where the graphitic structure is formed of graphite flakes or pseudonodular graphite particles, the tensile strength is still lower in the approximate range of from 25 to 35 kgf/mm$^2$ and the Brinell hardness in the neighborhood of HB 100. When they are applied to such parts as are required to have high accuracy, therefore, the produced parts often pose problems of deformations of various sorts due to insufficient strength. Owing to the softness, they find only limited applications to such sliding parts as are in need of resistance to abrasion.

Besides the materials cited above, JP-A-61-177,356 discloses a low thermal expansion high-nickel content austenite graphite cast iron of the shape of vermicular, JP-A-02-298,236 an alloy having low thermal expansion at a relatively high temperature, JP-A-64-55,364 a low thermal expansion cast iron endowed with improved strength by a heat treatment, JP-B-01-36,548 a low thermal expansion alloy incorporating Ni, Co, V, and Nb therein, JP-A-02-70,040 a low thermal expansion alloy endowed with improved strength by a solid solution treatment, and JP-A-63-433 a graphite cast iron of the shape of vermicular. None of them satisfies both high strength and low expansion; some of them are deficient in strength and others in low expansion.

It is further known that low expansion cast irons having a graphite structure generally incur conspicuous Ni segregation and, because of the liability to have a low Ni concentration in the gap of the Dendrite phase, produce a part deviating from the Invar composition and suffer from deficiency in low expansion as compared with the Invar alloy and the Super Invar alloy which form no graphite. Generally, this problem of Ni segregation is solved by the method of subjecting the low expansion cast iron to a solid solution treatment at a temperature in the range of from 750° C. to 950° C. and then to rapid cooling. This method, however, entails the problem of causing the heat-treated cast iron to deform. Particularly in the case of a low thermal expansion cast iron, since it is an alloy of high Ni content, it has low thermal conductivity as compared with ordinary cast iron and, when hardened in water or oil, shows a large difference in cooling speed between the surface layer and the inner part of a shaped part of the low expansion cast iron and consequently gives rise to a large stress of heat treatment. Thus, the shaped part is destined to retain residual stress if not suffered to induce growth of deformation. Further, since this residual stress is liberated during the course of mechanical fabrication or with the elapse of time, the shaped part of the low expansion cast iron brings about degradation of shape or dimensional accuracy. As a result, it has been necessary for the heat-treated cast iron to undergo a protracted heat treatment which is adapted for the relief of strain.

In association with the recent trend of the products of cast iron toward growth in size and complication in shape, the present inventors have taken notice of the fact that the heat treatment which is given after the step of casting inevitably impairs the reliability of the products. It has been ascertained to them, for example, that the heat treatment which has brought about a favorable effect on the conventional surface plate having 55 cm in diameter and 40 mm in thickness brings about an unfavorable effect of impairing the flatness of surface of a surface plate having 1 m in diameter and 40 mm in thickness.

In the case of such products as are complicated in shape, since they have been fabricated heretofore by machining, the strain which is generated by stress within these products in the process of fabrication has likewise posed a problem. To be relieved of this strain, these products must undergo a time-consuming strain-relieving heat treatment. By reason of the complicatedness of this heat treatment, the desirability of cast products manufacturable without requiring the heat treatment has been finding popular approval. The improvement which is attained in the low expansion property by the heat treatment (particularly for rapid cooling) possibly exerts an adverse effect on the improvement of the dimensional accuracy which constitutes the primary object of the heat treatment. Thus, in the case of the products of complicated shapes which have been heretofore manufactured by machining because the strain-relieving heat treatment applicable thereto is unduly intricate, the desirability of obtaining these products by casting without entailing development of strain due to stress has been finding approval. The cast products, therefore, are desired to retain their inherently low expansibility as cast as much as possible.

DISCLOSURE OF THE INVENTION

In the existing circumstance that machines of various kinds are tending toward increasingly large dimensions, increasingly complicated shapes, and increasingly high operational accuracy, the conventional low-expansion cast iron in no infrequent cases fails to adapt fully to such machines in terms of mechanical strength, hardness, or the like. The semiconductors which have been produced in recent years, for example, have markedly increased numbers of components per chip. Consequently, the Si wafers to be used for the semiconductors are required to possess surface flatness of increasingly high accuracy. Meanwhile, the Si wafers have been tending year after year toward increasing diameters. They are said to be verging on the stage of transition from 4- to 5-inch discs to 8-inch discs. Under this circumstance, polishing surface plates made of low-expansion cast iron have been finding growing adoption for the purpose of machining the Si wafers. Since the production of Si wafers in an increased diameter naturally urges these polishing surface plates toward growth in size, the cast iron for use in the polishing surface plates is required to possess tensile strength of not less than 55 kgf/cm$^2$ indispensable to the retention of the accuracy of shape besides satisfying low expansibility.

In consideration of the possible use of this low-expansion cast iron in sliding parts, for example, the cast iron is desired to possess enhanced hardness for the purpose of enabling the sliding parts to manifest exalted resistance to abrasion. Since the hardness also affects the property of cuttability, the cast iron is desired to acquire a suitable degree of hardness for the sake of improving the cuttability.

Specifically, the cast iron to be obtained by the method of production according to this invention is required to possess the following properties.

Firstly, the cast iron requires to show low expansibility. According to the results of the inventors' study and with due consideration for the second through the fourth property, it is concluded that the cast iron is desired to have a coefficient of thermal expansion of not more than $8\times10^{-6}$ at temperatures in the range of from room temperature to 100° C.

Secondly, the cast iron requires tensile strength. In the light of the results of the inventors' study, it is concluded that the cast iron is desired to have tensile strength of not less than 55 kgf/mm$^2$ to keep the shape and size thereof intact in addition to satisfying the coefficient of thermal expansion mentioned above.

Thirdly, the cast iron requires abrasion resistance, namely hardness. It is desired to have Brinell hardness of not less than 200 to acquire desired abrasion resistance in addition to satisfying the thermal expansion and the tensile strength mentioned above.

Fourthly, the cast iron requires such cutting workability and castability as are proper for any cast iron.

Now, the advantages of the fact that a cast product is a material as cast will be described below.

Generally, a cast product is vested with a desired property by a heat treatment which is performed after the step of casting. This heat treatment inflicts residual stress on the interior of the cast product. Normally, this cast product is subjected to a strain relieving heat treatment to be relieved of this residual stress. This heat treatment, however, proves complicated from the operational point of view and, at times, fails to attain the removal of residual stress, depending on the particular kind of product, as remarked above. To avoid this problem, therefore, the cast iron is desired to be a material as cast.

During this heat treatment, the cast product must not suffer degradation of the four properties mentioned above. In addition to satisfying simultaneously the four properties mentioned above, the cast product is desired to be a material as cast.

This invention, produced for the purpose of coping with the various problems remarked above, has for an object thereof the provision of a method for the production of high-strength low-expansion cast iron which is endowed with enhanced strength and hardness and also with improved cutting workability and meanwhile enabled to keep low expansibility intact.

The present invention has for another object thereof the provision of a method for the production of high-strength low-expansion cast iron infallibly endowed with low expansibility without undergoing such a heat treatment as the quench hardening which is effected by a sudden fall of temperature from a high to a low level.

This invention provides a method for the production of high-strength low-expansion cast iron, more particularly a method for the production of low-expansion cast iron of a high Ni content exhibiting a coefficient of thermal expansion of not more than $8\times10^{-6}$/° C. at temperatures in the range of from room temperature to 100° C., characterized by the steps of preparing a material consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and the balance of Fe and other inevitable impurities, melting the material and casting the melt in a mold of a stated shape, and enabling the carbide-forming element, while the melt is being solidified in the mold, to be precipitated in the form of a carbide at an area ratio in the range of from 0.3% to 20% in the metal structure.

The material of the aforementioned composition for the cast iron further incorporates therein not more than 1.2% by weight of Si for the sake of imparting castability and cuttability and not more than 1.0% by weight of Mn for the sake of promoting deoxidation, enhancing strength, and improving resistance to corrosion.

The carbide-forming element mentioned above is at least one element to be selected from the group consisting of the transition metallic elements of Groups IVa, Va, and VIa in the Periodic Table of the Elements.

This invention further provides a method for the production of high-strength low-expansion cast iron, more particularly a method for the production of low-expansion cast iron of a high Ni content exhibiting a coefficient of thermal expansion of not more than $8\times10^{-6}$/° C. at temperatures in the range of from room temperature to 100° C., characterized by the steps of preparing a material consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and the balance of Fe and other inevitable impurities, melting the material and casting the melt in a mold of a stated shape, and enabling the carbide-forming element, while the melt is being solidified in the mold, to be precipitated in the form of a carbide thereby lowering the content of dissolved carbon in the cast iron to not more than 0.4% by weight.

The material of the composition for the cast iron mentioned above further incorporates therein not more than 1.2% by weight of Si for the sake of imparting castability and cuttability and not more than 1.0% by weight of Mn for the sake of promoting deoxidation, enhancing strength, and improving resistance to corrosion.

The carbide-forming element mentioned above is at least one element to be selected from the group consisting of the transition metallic elements of Groups IVa, Va, and VIa in the Periodic Table of the Elements.

This invention further provides a method for the production of high-strength low-expansion cast iron, characterized by the steps of preparing a material consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and the balance of Fe and other inevitable impurities, melting the material and casting the melt in a mold of a stated shape, and enabling the carbide-forming element, while the melt is being solidified in the mold, to be precipitated in the form of a carbide in the metal structure thereby lowering the content of dissolved carbon in the cast iron and producing low-expansion cast iron exhibiting a coefficient of thermal expansion of not more than $8\times10^{-6}/°$ C. at temperatures in the range of from room temperature to 100° C. and tensile strength of not less than 55 kgf/mm$^2$.

The material of the composition for the cast iron mentioned above further incorporates therein not more than 1.2% by weight of Si for the sake of imparting castability and cutting workability and not more than 1.0% by weight of Mn for the sake of promoting deoxidation, enhancing strength, and improving resistance to corrosion.

The carbide-forming element mentioned above is at least one element to be selected from the group consisting of the transition metallic elements of Groups IVa, Va, and VIa in the Periodic Table of the Elements.

The carbide-forming element is precipitated in the form of a carbide at an area ratio in the range of from 0.3% to 20% in the metal structure.

The content of the dissolved carbon in the cast iron is not more than 0.4% by weight.

A method for the production of a polishing surface plate, is characterized by the steps of preparing a material consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and the balance of Fe and other inevitable impurities, melting the material and casting the melt in a mold of a stated shape, and enabling the carbide-forming element, while the melt is being solidified in the mold, to be precipitated in the form of a carbide at an area ratio in the range of from 0.3% to 20% in the metal structure.

The material of the composition for the cast iron of the polishing machine further incorporates therein not more than 1.2% by weight of Si for the sake of imparting castability and cuttability and not more than 1.0% by weight of Mn for the sake of promoting deoxidation, enhancing strength, and improving resistance to corrosion.

The carbide-forming element mentioned above is at least one element to be selected from the group consisting of the transition metallic elements of Groups IVa, Va, and VIa in the Periodic Table of the Elements.

The polishing surface plate has a large bulk not less than 600 mm in diameter and, in one aspect, is characterized by the fact that it is obtained as cast and obviates the necessity of undergoing a heat treatment after the casting.

The cast iron mentioned above is characterized in that the content of the dissolved carbon in the cast iron is lowered to not more than 0.4% by weight.

The method of production mentioned above is characterized by allowing production of a high-strength low-expansion cast iron polishing machine which is formed of cast iron having a coefficient of thermal expansion of not more than $8\times10^{-6}/°$ C. at temperatures in the range of from room temperature to 100° C. and tensile strength of not less than 55 kgf/mm$^2$.

A method for the production of a rod for use in a laser oscillator, is characterized by the steps of preparing a material consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and the balance of Fe and other inevitable impurities, melting the material and casting the melt in a mold of a stated shape, and enabling the carbide-forming element, while the melt is being solidified in the mold, to be precipitated in the form of a carbide at an area ratio in the range of from 0.3% to 20% in the metal structure.

In the method for the production of a rod for use in a laser oscillator according to this invention, the material of the composition for the cast iron of the rod further incorporates therein not more than 1.2% by weight of Si for the sake of imparting castability and cuttability and not more than 1.0% by weight of Mn for the sake of promoting deoxidation, enhancing strength, and improving resistance to corrosion.

The carbide-forming element mentioned above is at least one element selected from the group of the transition metallic elements of Groups IVa, Va, and VIa in the Periodic Table of the elements.

Further, the method for the production of a rod for use in a laser oscillator according to this invention is characterized by not including a heat treatment subsequent to the step of casting.

The cast iron mentioned above is characterized in that the content of the dissolved carbon in the cast iron is lowered to not more than 0.4% by weight.

The method of production mentioned above is characterized by allowing production of a high-strength low-expansion cast iron rod for use in a laser oscillator which is formed of cast iron having a coefficient of thermal expansion of not more than $8\times10^{-6}/°$ C. at temperatures in the range of from room temperature to 100° C. and tensile strength of not less than 55 kgf/mm$^2$.

The invention described above has been perfected on the basis of the following knowledges. The avoidance of impairment of the property of low expansion to the fullest possible extent has been the first condition of this invention. In other words, the essence of the present invention consists in using the basic composition of a Super Invar alloy (30%Ni—5%Co—65%Fe) as a base metal and repressing the content of solid solutions with other elements in the matrix to the fullest possible extent. To be more specific, the present inventors have acquired a knowledge that the desired property of low expansion is obtained by lowering the content of dissolved carbon in the cast iron to not more than 0.4% by weight. Since this is practical purpose cast iron having a graphitic structure, it naturally tolerates the presence of such elements as C, Si, Mn, and Mg and impurities which are inevitably contained therein. The coefficient of thermal expansion of the low-expansion cast iron of the present invention is not more than $8\times10^{-6}/°$ C. at temperatures in the range of from room temperature to 100° C.

Then, for the sake of improving strength and hardness, this invention has the enhancement of the dispersion of a third phase for the second condition. This enhancement is attained by adding a carbide-forming element as a dissolving component and inducing deposition of a carbide in the process of solidification. The present inventors have acquired a novel knowledge that owing to this mechanism, the dissolved carbon is consumed in the form of a carbide and this consumption can be expected to produce an effect of lowering the thermal expansion coefficient of the alloy. If the amount of the carbide-forming element is added in an excess of the amount so consumed as the carbide, however, the excess adds itself to the solid solution and rather increases the thermal expansion coefficient than decreases it. Thus, the amount of this addition must be proper.

The present inventors have further found the conditions under which a means to retain intact the property of low expansion possessed by the iron alloy as cast without requiring any heat treatment for rapidly cooling the alloy from an elevated temperature is realized within the scope of the method mentioned above. They have been ascertained that when the carbide and graphite are both formed during the solidification in the process of casting, the amount of dissolved carbon in the solidifying phase is generously lowered and the segregation of Ni is repressed. In accordance with these conditions of formulation, there is obtained a method for the production of a high-strength low-expansion cast iron which, as cast, acquires the same property of low expansion as the material which has undergone a rapidly cooling treatment and, avoids the change of size and shape with aging due to thermal deformation and the relief of residual stress.

The knowledges described above have been confirmed by the following experimental data.

From copious experimental data shown in FIG. 7, the present inventors have acquired a novel knowledge that the strength properties (tensile strength, proof strength, Young's modulus, and hardness) of the conventional low-expansion cast iron which contains no carbide in the metal structure have a very close relation with the carbon content of the cast iron. FIG. 8 shows the relation between the total carbon content and the dissolved carbon content. In the region in which graphite is crystallized in the cast material when the total carbon content is not less than about 1%, the ratio of graphitization is heightened in proportion as the total carbon content is increased and, as a result, dissolved carbon content tends to decrease. In short, the strength and hardness of a low-expansion cast iron are increased by increasing the dissolved carbon content. However, since an increase in the amount of dissolved carbon results in an increase in the thermal expansion coefficient, it is difficult to satisfy both high strength and low expansion at the same time.

This invention has issued from a novel knowledge that by effecting the formation of a carbide in the metal structure of a low-expansion cast iron, the dissolved carbon content can be decreased to a far greater extent than when no carbide is present as shown in FIG. 8.

In the method of this invention for the production of a high-strength low-expansion cast iron, nickel (Ni) is a component which contributes to austenite the metal structure of cast iron and lower the thermal expansion coefficient of the cast iron. The low-expansion cast iron is obtained effectively when the Ni content thereof is made to fall in the range of from 25 to 40% by weight. If the Ni content deviates in either way from this range, the thermal expansion coefficient will be increased. The Ni content is preferably in the range of from 28 to 36% by weight.

Cobalt (Co) and Ni produce a synergistic effect of further lowering the thermal expansion coefficient of cast iron. If the cobalt content exceeds 12% by weight, however, it will conversely increase the thermal expansion coefficient. In the alloy as cast which has not undergone any particular heat treatment, Ni and Co are segregated therein and consequently exert adverse effects on the property of low expansion. Co is to be added, therefore, in due consideration of the thermal expansion coefficient and other factors which the cast iron is required to possess.

Carbon (C) is a component which induces crystallization of graphite in the low-expansion cast iron and imparts castability, cuttability, workability, etc. to the cast iron. The carbon which has escaped graphitization continues to exist as a carbide and the dissolved carbon content. This invention features the improvement of the strength and hardness of a low-expansion cast iron by the formation of a carbide in the metal structure thereof. In this respect, therefore, carbon constitutes itself the most important component element. The excess carbon is a carbon component for a dissolved carbon and forms a cause for an increase in the thermal expansion coefficient. It is, therefore, important to set the amount of carbon so as to lower the dissolved carbon content to the fullest possible extent. In this invention, the carbon content is in the range of from 0.3 to 2.5% by weight. If the carbon content is less than 0.3% by weight, no ample castability will be imparted. If the carbon content exceeds 2.5% by weight, the thermal expansion coefficient will be unduly large. When the carbon content is in the range of from 0.3 to 1.0% by weight, no graphite is crystallized but a carbide is only formed in the cast iron which has not undergone any heat treatment. In this case, the cuttability and property of low expansion can be improved by subjecting the cast iron to a heat treatment which is aimed at secondary graphitization. When the carbon content is in the range of from 1.0 to 2.5% by weight, both graphite and the carbide are formed in the cast iron as cast. Thus, the low-expansion cast iron consequently obtained excels in both cuttability and property of low expansion. Preferably, the carbon content is in the range of from 1.0 to 1.5% by weight. By including the formation of a carbide for an additional condition in this invention, therefore, the dissolved carbon content in the solidifying phase can be kept at a low level and the Ni segregation can be repressed to a negligible extent. When the carbon content is in this range, the cast iron as cast acquires a property of low expansion close to that of a cast iron which has undergone a heat treatment with rapid cooling.

Silicon (Si) in this invention plays only meagerly the parts in the graphitization of ordinary cast iron as offering sites for the formation of graphite cores and constituting a component equivalent to carbon. In the low-expansion cast iron of this invention, silicon is incorporated for the purpose of repressing the oxidation of cast iron during melting in the open air. The silicon content, therefore, is desired to be as low as possible. It is not more than 1.2% by weight, preferably not more than 0.5% by weight.

Manganese (Mn) is one of the basic components of cast iron and functions as a deoxidizing agent or an agent for enhancing strength and resistance to corrosion. If it is contained in an unduly large amount, the excess will increase the dissolved manganese content in the cast iron and proportionally enhance the thermal expansion coefficient. The Mn content, therefore, is not more than 1.0% by weight, preferably not more than 0.5% by weight.

Magnesium (Mg) or calcium (Ca) functions as a component for the formation of nodular graphite or as a deoxidizing agent for cast iron. Similarly to Mn, the upper limit of the Mg or Ca content is fixed at 0.1% by weight for the purpose of preventing growth of thermal expansion coefficient. Generally, Mg is used mainly. A Ni—5% Mg alloy or a Fe—5%Mg alloy is added after the raw material blend has been melted and immediately before the melt is cast and is consequently allowed to react with the melt. For the spheroidization of graphite, the cast iron after solidification generally requires to have a Mg or Ca content in the range of from 0.04 to 0.09%. If the Mg or Ca content is in the range of from 0.01 to 0.03%, the graphite will assume the form of decayed spheroids called a psuedonodular graphite or CV cast iron graphite. If the Mg and Ca contents have only effected deoxidization and remain in the order of not more than 0.01%, the graphite will assume a flake graphite. The property of low expansion is exalted and the strength is conversely degraded in proportion as the ratio of spheroidization of graphite decreases because the ratio of the amount of carbon transformed into graphite in all the carbon content will be increased and the amount of dissolved carbon will be lowered.

As other impurities, phosphorus (P) and sulfur (S) are contained in practical cast iron. Since they are undesirable contents for the purpose of this invention, their contents are desired to be as small as possible. The total content of phosphorus and sulfur, therefore, is not more than 0.2% by weight.

As the carbide-forming element, at least one element selected from the group of transient elements belonging to the IVa, Va, and VIa Groups in the Periodic Table of the Elements, preferably one element selected from among Ti, Zr, Hf, V, Nb, Ta, Cr, Mo, and W. This element is added in an amount in the range of from 0.1 to 6.0% by weight. These elements are invariably the transition elements of the IVa, Va, and VIa Groups and have low levels of free energy for the formation of a carbide in an iron alloy. The carbides of these elements are more liable to nucleate than graphite. When the cast iron has a carbon content of not more than 0.9%, no graphite is formed and only a carbide is precipitated in the metal structure. If the low-expansion cast iron contains no carbide-forming element, there will arise such a carbon concentration gradient as has the lowest dissolved carbon content in the neighborhood of graphite and a high carbon content between graphites (dendrite gaps). As a result, the Ni which is expelled by the carbon is caused to form a concentration gradient and give rise portions of a low Ni content between graphites (dendrite gaps) (reverse segregation). The present inventors, however, have found that the carbide-forming element mentioned above rather segregates between graphites and forms a carbide and produces an effect of cancelling the concentration of gradient of the dissolved carbon content due to the formation of graphite. They have further found that the precipitation of the carbide enhances the strength, Young's modulus, and hardness and decreases the dissolved carbon content and the cancellation of the Ni segregation exalts the property of low expansion. While the low-expansion cast iron relies on graphite to mend the defect of poor workability due to the stickiness of the austenite base matrix peculiar to high-nickel cast iron, it has been found that the precipitation of the carbide is effective in adjusting the stickiness and enhancing the workability.

The carbide-forming elements enumerated above can be used either singly or in the form of a mixture of two or more members. The amount of the carbide-forming element to be added is in the range of from 0.1 to 6.0% by weight at a total, though variable with the amount of carbon. If the amount of the carbide-forming element to be contained is less than 0.1% by weight, the carbide will not be sufficiently formed and the effects mentioned above will not be obtained fully satisfactorily. Conversely, if the content of the carbide-forming element exceeds 6.0% by weight, the precipitated carbide will coarsen and not only fail to contribute to the enhancement of strength but also impede toughness and mechanical workability. The amount of the carbide-forming element to be added is in the range of from 0.2 to 4.0% by weight, preferably from 0.5 to 2.5% by weight.

The individual elements have proper amounts of their own. They are desired to satisfy the following relevant ranges in order that the carbide may be prevented from coarsening and may be finely dispersed and precipitated in the base matrix. The range for Ti is from 0.1 to 1.0% by weight, that for Zr from 0.1 to 1.0% by weight, that for Hf from 0.1 to 3.0% by weight, that for V from 0.4 to 1.2% by weight, that for Nb from 0.1 to 2.0% by weight, that for Ta from 0.1 to 4.5% by weight, that for Cr from 0.2 to 6.0% by weight, that for Mo from 0.1 to 2.5% by weight, and that for W from 0.1 to 4.5% by weight.

The carbide-forming element in this invention is desired to have at least 75%, preferably not less than 80%, and more preferably practically 100%, thereof to be present in the form of a precipitated phase. This is because the carbide-forming element contained in a solid solution has an adverse effect on the thermal expansion coefficient. For the purpose of enabling the carbide-depositing element practically wholly to be present in the precipitation phase and not remain as a solid solution in the base matrix, it suffices to calculate the limits of the amount of the element on the basis of the composition of the carbide of each element and add the carbide-forming element in an amount falling within the found limits. In the case of titanium, for example, the carbide to be formed is TiC. Since the density $\rho_{T1}$ of titanium is 4.54 gr/cm$^3$ and the density $\rho_C$ of carbon is 2.25 gr/cm$^3$ and the density of Ti is about 2.0 times that of C, the amount of titanium to be added is desired to be about 2.0 times the amount of the carbon which remains after graphitization. The amount of the residual carbon mentioned above is generally in the range of from 0.5 to 0.7% by weight. If the amount of titanium to be added exceeds about 1.4%, therefore, the excess will form a solid solution in the base matrix substrate and increase the thermal expansion coefficient. For the other elements, it is desirable to find limits of their respective amounts and set their proper amounts of addition in the same manner as described above. By thus setting the amounts of the carbide-forming elements to be added, the amounts of relevant solid solutions are extremely decreased and the property of low expansion is not affected.

For the method of this invention, the amount of the precipitated carbide is desired to be in the range of from 0.3 to 20% in terms of area ratio in the metal structure. If the area ratio of the precipitated carbide is less than 0.3%, the method will produce no sufficient effect on strength, hardness, cuttability and workability, and property of low expansion. If it exceeds 20%, the thermal expansion coefficient and hardness of the carbide will bring about adverse effects and degrade the property of low expansion and cuttability and workability. The area ratio of the precipitated carbide is desirably in the range of from 0.5 to 10%, and more desirably from 1.5 to 5.0%.

The grain size of the carbide also affects mechanical properties and cuttability and workability. The grain size of the carbide which is desired to be in the range of from 5 to 50 $\mu$m can be controlled by adjusting the amount of carbon and the content of the carbide-forming element. The aforementioned ranges of the amounts of the components of the low-expansion cast iron have been fixed with consideration to the fast just mentioned.

Then, the about of the nodular graphite precipitated in the low-expansion cast iron of the present invention is desired to be in the range of from 0.5% to 15% in terms of area ratio in the metal structure. If the amount of the precipitated nodular graphite exceeds 15%, the excess will exert an adverse effect on the strength of the cast iron. The upper limit of this range is desired to be 10%. The upper limit of the amount of carbon, therefore, is fixed at 2.5%.

In this invention, the area ratio mentioned above is determined by the following method.

First, a photomicrograph of a ground cross section of a given low-expansion cast iron sample will be prepared. The cross section is etched with an aqueous 10% aqua regia solution to vivify the state of precipitation of the carbide. The photomicro-graph is desired to be obtained at 20 magnifications. The area ratio is defined by the following formula:

Area ratio, %, of the amount of precipitated carbide=Total area of carbide/(total area of base matrix+total area of carbide+total area of graphite)

The total areas of carbide and graphite have been recently determined by examining a given photomicrograph by the use of an image analyzing device. A photograph magnified to a size of not less than 300 mm×200 mm is cut into areas of carbide, graphite, and base matrix. The areas of photograph are weighed and the area ratios are calculated on the basis of the weights thus found.

Now, the heat treatment will be described.

The heat treatment performed in this invention is primarily aimed at forming secondary graphite when the amount of carbon is relatively small and the cast iron as cast permits either no or only insufficient crystallization of graphite. With the composition of the cast iron of the formulation of this invention having a carbon content in the range of from 0.3 to 1.0%, the cast structure has the carbide only precipitated and dispersed in the austenite base matrix or only a very small amount of graphite formed therein. Thus, the cast iron is deficient in cuttability and workability. By subjecting this cast iron to a solid solution treatment at a temperature in the range of from 750 to 900° C., the formation of the secondary graphite is attained. The time used for the solid solution treatment depends on the wall thickness of the cast iron to be produced. The time which is calculated in accordance with the following formula serves as the standard.

Time for solid solution treatment=Largest wall thickness/25 mm×2 hours+2 hours

The range of the temperature of the solid solution treatment is set as mentioned above because the carbide is decomposed at temperatures exceeding 900° C. and the amounts of dissolved carbon and carbide-forming element are consequently increased and the thermal expansion coefficient is increased rather than decreased.

In the method of this invention for the production of a high-strength low-expansion cast iron, a structure having the carbide dispersed and precipitated is obtained even by the ordinary steps of melting and casting. A structure having the carbide more uniformly and finely dispersed and precipitated can be obtained by a heat treatment. Since this treatment consists in rapidly cooling a melt from a high temperature, it is employed only when the shape, wall thickness, etc. of the product have no problem as mentioned above. To be more specific, after the components for an alloy are melted and cast, the cast alloy is subjected to the solid solution heat treatment at a temperature in the range of from 750 to 900° C., and the hot alloy is rapidly cooled in such a hardening medium as water, oil bath, or salt bath. As a result, there is obtained a structure in which the Ni segregation is cancelled and the carbide is finely dispersed. In a structure having the carbide finely divided and dispersed therein as described above, the exaltation of strength is effectively attained. For example, the produced structure manifests tensile strength of not less than 55 kgf/mm$^2$ and hardness (Brinnel hardness) of not less than HB 220 while maintaining a thermal expansion coefficient of not more than $5\times10^{-6}$/° C. (at temperatures in the range of from room temperature to 100° C.).

BEST MODE FOR EMBODYING THE INVENTION

Figure 1:
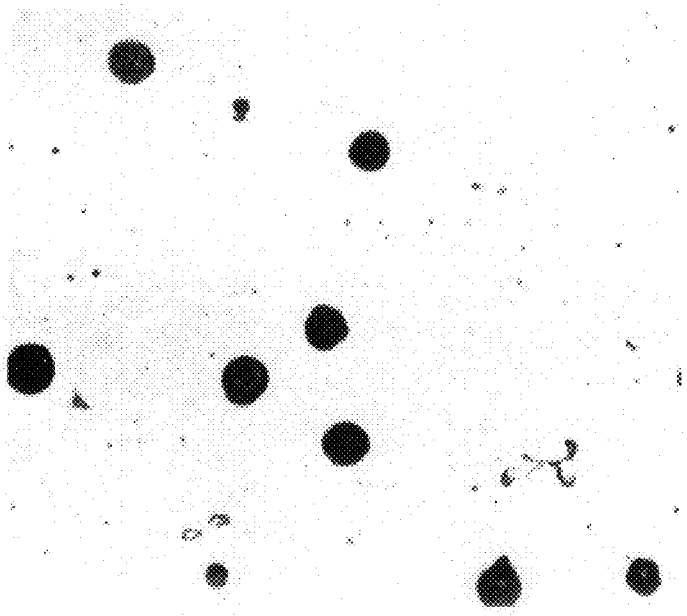
FIG. 1 is an optical photomicrograph showing the metal structure of a conventional low-expansion alloy having graphite alone precipitated therein.

Now, the present invention will be described below with reference to working examples.

Examples 1 to 12 and Comparative Examples 1 to 5

Varying cast iron materials having a formulation shown in Table 2-1 were melted by the use of a high-frequency electric furnace having a capacity for 100 kg. The resultant melt was cast in a sand mold to produce a cast iron sample measuring 25 mm×150 mm×200 mm and weighing about 6 kg. The samples of Examples 1 to 12 and Comparative Examples 1 to 5 were as cast and not subjected to a heat treatment and were severally tested for thermal expansion coefficient (room temperature to 100° C.), tensile strength, Young's modulus, Brinnel hardness HB, and amount of precipitated carbide in the metal structure. The test results are shown in Table 2-2.

The formulations of Examples 1 to 12 were the sums of fundamental compositions conforming to the present invention and suitable amounts of carbide-forming elements used either singly or in the form of a mixture of two or more members. In contrast, in Comparative Examples 1 to 5, the formulations of Comparative Example 1 and 2 avoided containing a carbide-forming element, the formulation of Comparative Example 3 contained a carbide-forming element in an excess amount, the formulation of Comparative Example 4 contained nickel and other elements in a composition different from the basic composition of this invention, and the formulation of Comparative Example 5 contained a carbide-forming element in an unduly small ratio.

In these comparative examples, Comparative Example 5 was produced from the composition proposed in JP-A-62-205244 containing 0.02% of Nb and 0.2% of V. The cast iron consequently produced showed virtually no sign of formation of a carbide or no sign of improvement in strength.

It is clearly noted from the test results shown in Table 2-2 that low-expansion cast iron samples from formulations of the working examples of this invention showed thermal expansion coefficients of not more than $7\times10^{-6}$/° C., amounts of precipitated carbide in metal structure (area ratio) in the range of from 0.5 to 15%, tensile strength of not less than 62 kgf/mm$^2$, and HB levels of hardness of not less than 280 notwithstanding they were products which had been only cast and not subjected to a heat treatment.

The cast iron samples of Comparative Examples 1, 2 and 5 which contained no or only a small amount of carbide-forming element showed small amounts of precipitated carbide of not more than 0.2% and tensile strength of not more than 45 kgf/mm$^2$. The cast iron sample of Comparative Example 3 which contained a carbide-forming element in an amount (7%) exceeding the upper limit of the range contemplated by this invention precipitated a carbide in a large amount and, owing to solid solution of an unreactioned components, showed such a high thermal expansion coefficient as $12\times10^{-6}$/° C. The cast iron sample of Comparative Example 4 which contained component elements in amounts deviating from the ranges contemplated by this invention separated a carbide in a ratio exceeding 3% and showed a high thermal expansion coefficient of $8.5\times10^{-6}$/° C.

Figure 2:
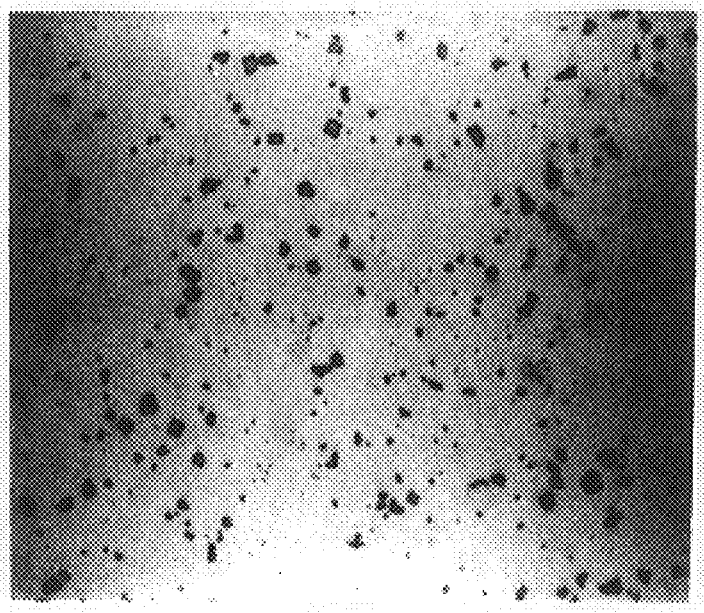
FIG. 2 is an optical photomicrograph showing the metal structure of a low-expansion alloy of this invention having a carbide alone dispersed therein.

When the metal metal structures of the cast iron samples of the working examples were examined under a microscope, it was confirmed that they invariably precipitated carbides uniformly and finely. As examples of these metal structure, an optical photomicrograph (200 magnifications) of the cast iron sample of Example 2 is shown in FIG. 2 and an optical photomicrograph (200 magnifications) of the cast iron sample of Comparative Example 1 is shown in FIG. 1. FIG. 1 shows only dispersion of nodular graphite and shows no sign of presence of carbide particles. FIG. 2 shows precipitation carbide particles of NbC and shows no sign of presence of graphite. The sample of Comparative Example 1 showed no precipitation of a carbide and that of Example 2 showed precipitation of a carbide and virtually no precipitation of graphite. The carbide particles which were precipitated at all in these samples invariably had small diameters of not more than 10 μm.

Examples 13 to 15 and Comparative Examples 6 to 10

Examples 13 to 15 represent the cases of giving a heat treatment additionally to the cast iron samples which were obtained exclusively by casting respectively in Examples 1, 2, and 12. These examples underwent a procedure which comprised a heat treatment performed at a temperature in the range of from 800 to 900° C. for about four hours, a solution heat treatment, and a water-cooling treatment. In the resultant products as cast, the excess dissolved carbon was transformed into secondary graphite by the solid solution treatment and Ni and Co were uniformly distributed by the rapid cooling. Particularly in the cast iron samples of Examples 13 and 14 which had carbon contents of not more than 1.0%, though the samples of Examples 1 and 2 produced no sufficient crystallization of graphite, the aforementioned procedure of heat treatments increased the amounts of graphite and, at the same time, slightly increased the amounts of precipitated carbides and decreased the amounts of dissolved carbon. Thus, Examples 13 to 15 lowered thermal expansion coefficients and increased tensile strength as compared with the properties exhibited by the samples of Examples 1 and 2. When the carbon contents were not more than 0.8%, the secondary graphite assumed a spheroidal shape and the strength was amply high notwithstanding the content of Mg or Ca as a graphite spheroidizing element was not more than 0.03%.

Figure 3:
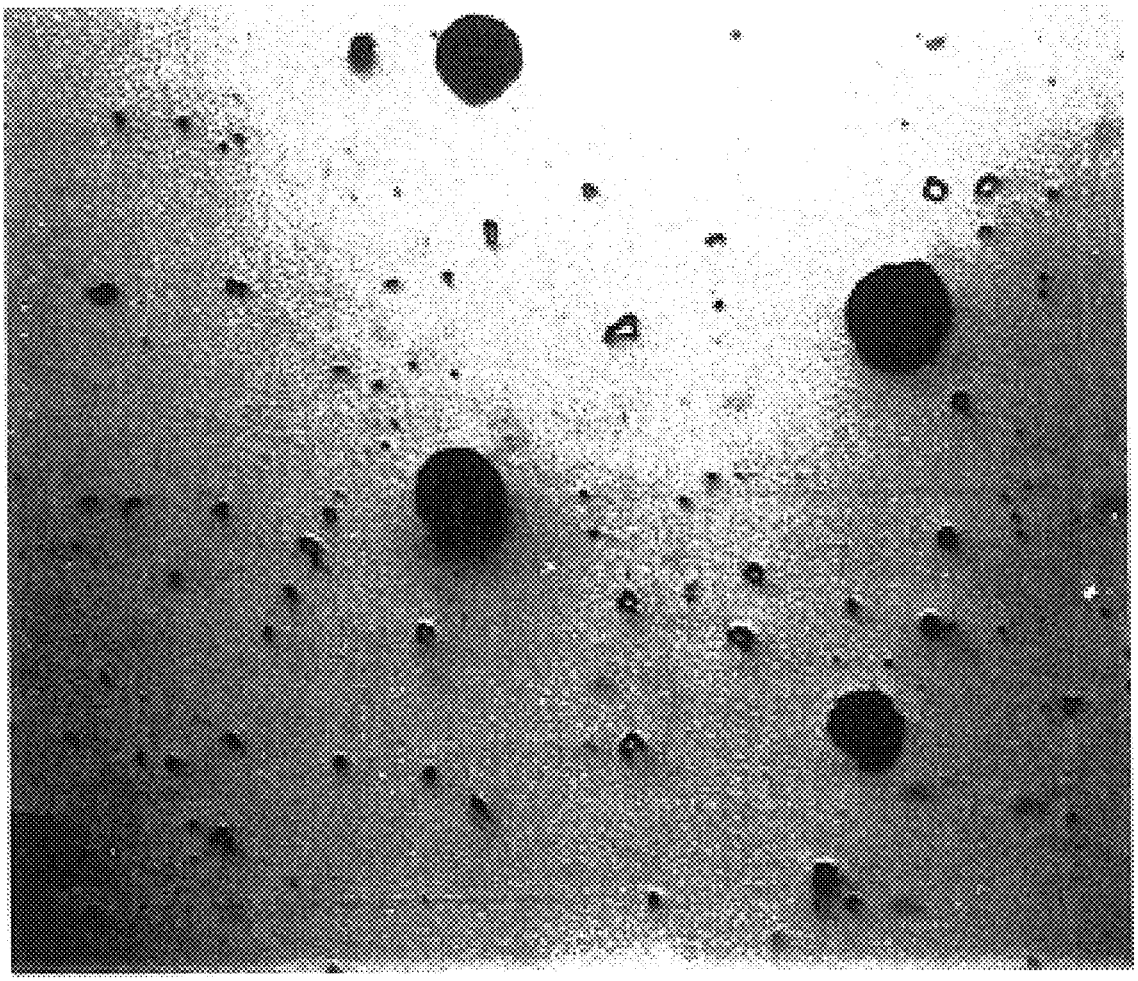
FIG. 3 is an optical photomicrograph showing the metal structure of a low-expansion alloy of this invention having a carbide and graphite dispersed therein.

FIG. 3 is an optical photomicrograph (200 magnifications) showing a cast iron sample of Example 14. This photograph shows the presence of both NbC particles and nodular graphite in the metal structure. The carbide particles having diameters of up to the maximum of 10 μm are observed to be uniformly dispersed and deposited in the metal structure. The nodular graphite had particle diameters ranging from 30 μm to 70 μm.

The sample of Example 15 had a high Co content of 11% as compared with the samples of the other examples. It required a heat treatment for uniformizing cobalt. Owing to this heat treatment, the thermal expansion coefficient was notably lowered as compared with the sample of the same formulation obtained in Example 12 as cast.

Comparative Examples 6 to 8 used the same heat treatments as in Examples 13 to 15 respectively. The temperature of solution heat treatment, however, was 850° C. in Comparative Example 6 and 950° C. in Comparative Example 8. Comparative Example 6 represented a case of adding a carbide-forming element in an unduly small amount. In this case, no carbide was formed notwithstanding a heat treatment was carried out. Comparative Example 7 represented a case of using a cobalt content of not less than 12% by weight. The sample obtained as cast failed to acquire a property of low expansion as desired. Comparative Example 8 represented a case of performing a solution heat treatment at temperatures in the range of from 900 to 1000° C., a level enough for thoroughly decomposition of a carbide. With the effect of rapid cooling as a contributory factor, the sample obtained a satisfactory thermal expansion coefficient of $2.8\times10^{-6}$/° C. Since this sample produced no precipitation of a carbide, it was inevitably deficient in such mechanical properties as tensile strength and hardness. Comparative Examples 9 and 10 represented cases of producing samples as cast without using a heat treatment. In these cases which used Si in amounts exceeding the upper limit of the range contemplated by this invention, the samples showed no sign of precipitation of a carbide-and were deficient in mechanical strength.

Example 16

Figure 4A:
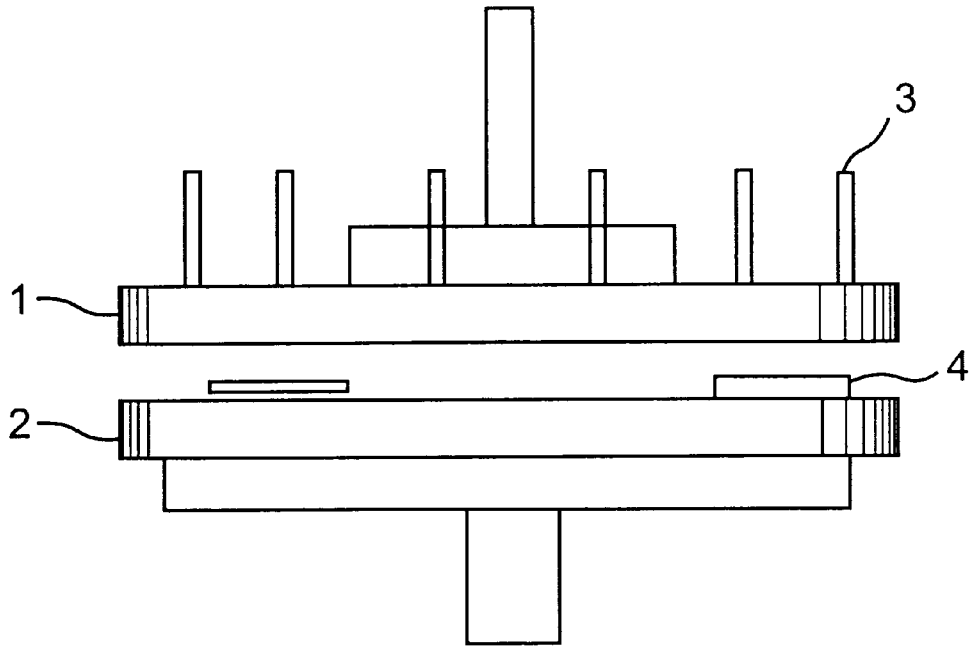
FIG. 4A is an explanatory diagram showing one example of the construction of a silicon wafer polishing surface plate according to this invention.
Figure 4B:
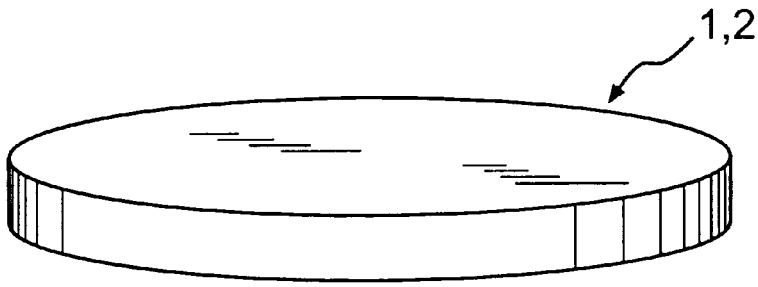
FIG. 4B is a perspective view showing one example of the polishing surface plate of this invention shown in FIG. 4-A.

This example concerned a polishing surface plate using a high-strength low-expansion cast iron of this invention. FIG. 4-A is an explanatory diagram showing schematically the construction of a polishing surface plate for use in the mechanochemical polishing of a silicon wafer as a semiconducting substrate. FIG. 4-B is a perspective view showing one example of the polishing surface plate. In the diagram, 1 stands for an upper surface plate, 2 for a lower surface plate, 3 for an abrasive slurry feed pipe, and 4 for a wafer for polishing. In a high-frequency electric furnace having a capacity for 5000 kg, 4000 kg of cast iron of a formulation shown in Table 3 was melted. A polishing surface plate shaped as shown in FIG. 4-B was produced by casting the melt of cast iron with a sand mold. The resultant cast product was cut to obtain a finished surface plate 1000 mm in diameter and 40 mm in thickness. Generally, it is extremely difficult for a plate shaped like this to retain the flatness of its shape intact during the hardening treatment. For the sake of stable retention of the flatness of shape, this plate is required to be a product as cast. The cast product, as shown in Table 3, exhibited highly desirable properties such as thermal expansion coefficient of $1.0\times10^{-8}/°$ C., tensile strength of 70 kg/mm$^2$, and hardness of HB 300. The cast iron surface plate of the present example which was obtained without a heat treatment showed Young's modulus about 1.5 times that of the conventional brass surface plate and thermal expansion coefficient about 1/20 times that of the brass surface plate and produced only small flexure under own weight. Further, with this cast iron surface plate, the yield of silicon wafers having LTV values of the flatness of not more than 1.0 $\mu$m was about 1.5 times that of the conventional brass surface plate. The expression "LTV value of the flatness being 1.0 $\mu$m" used above means that the difference between the largest and the smallest wall thickness within a given area of 15 mm×15 mm taken on a polished wafer surface was not more than 1.0 $\mu$m. Separately, a surface plate of 550 mm in diameter was produced by repeating the procedure of the present example described above. The cast product of this size exhibited highly desirable properties as shown in Table 3 when it was given a heat treatment and further relieved of residual stress.

Example 17

Figure 5:
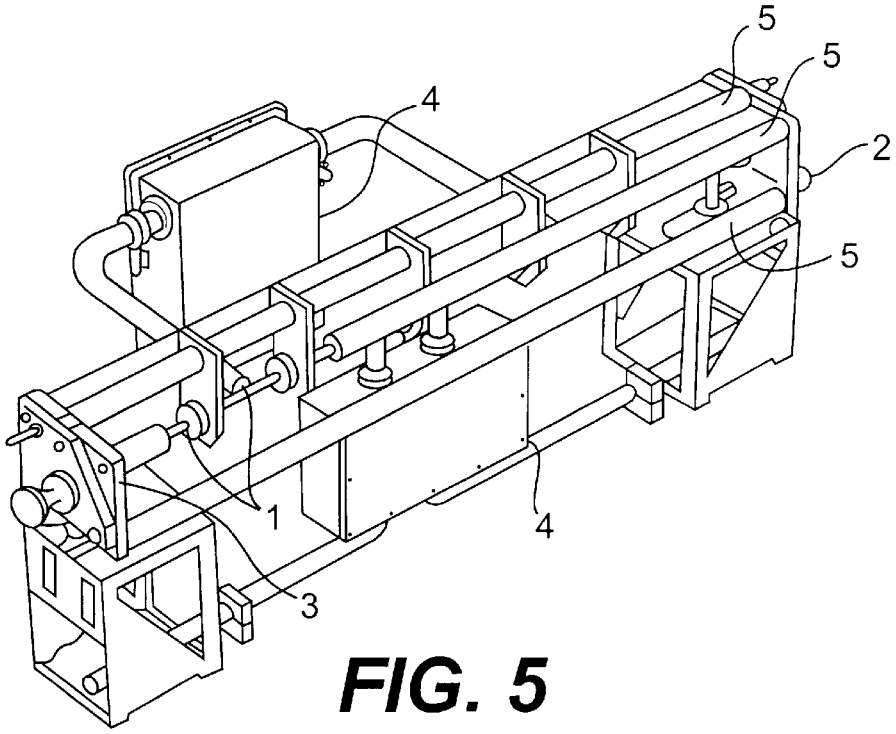
FIG. 5 is a schematic diagram showing the construction of a laser oscillator using a laser oscillator grade rod of this invention.
Figure 6:
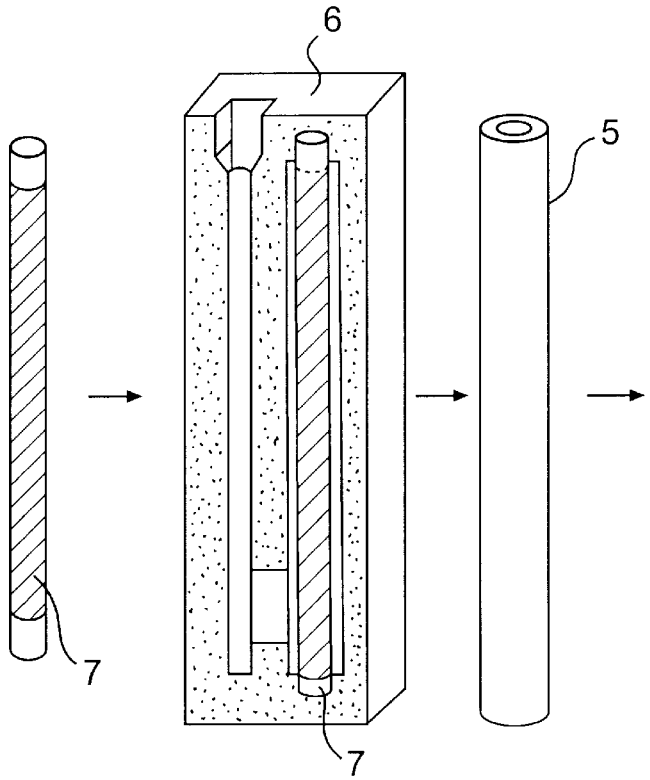
FIG. 6 is a schematic diagram for aiding in the explanation of the laser oscillator grade rod according to this invention.
Figure 7:
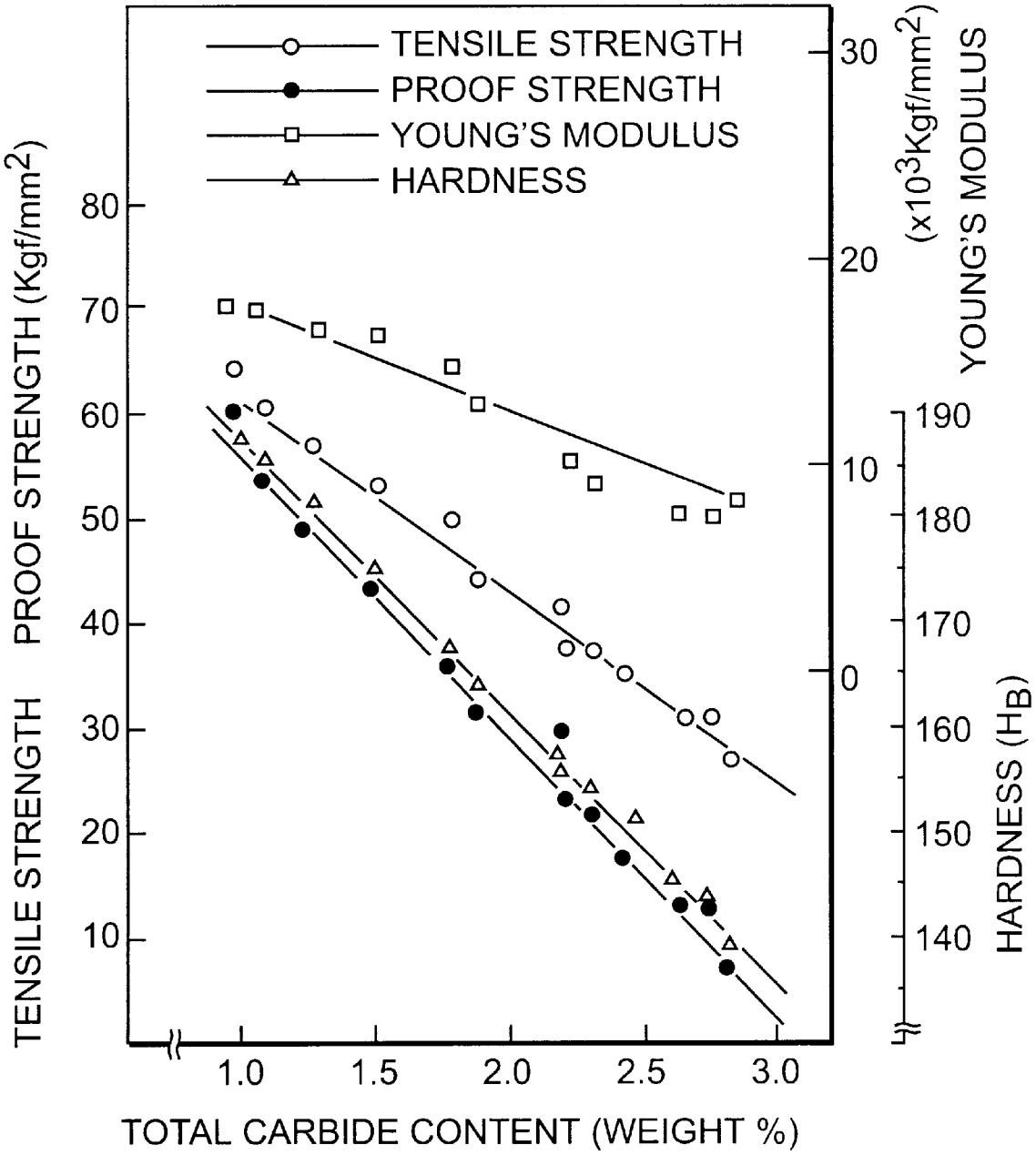
FIG. 7 is a diagram showing the relation between the total carbon content and mechanical properties of a conventional low-expansion cast iron.
Figure 8:
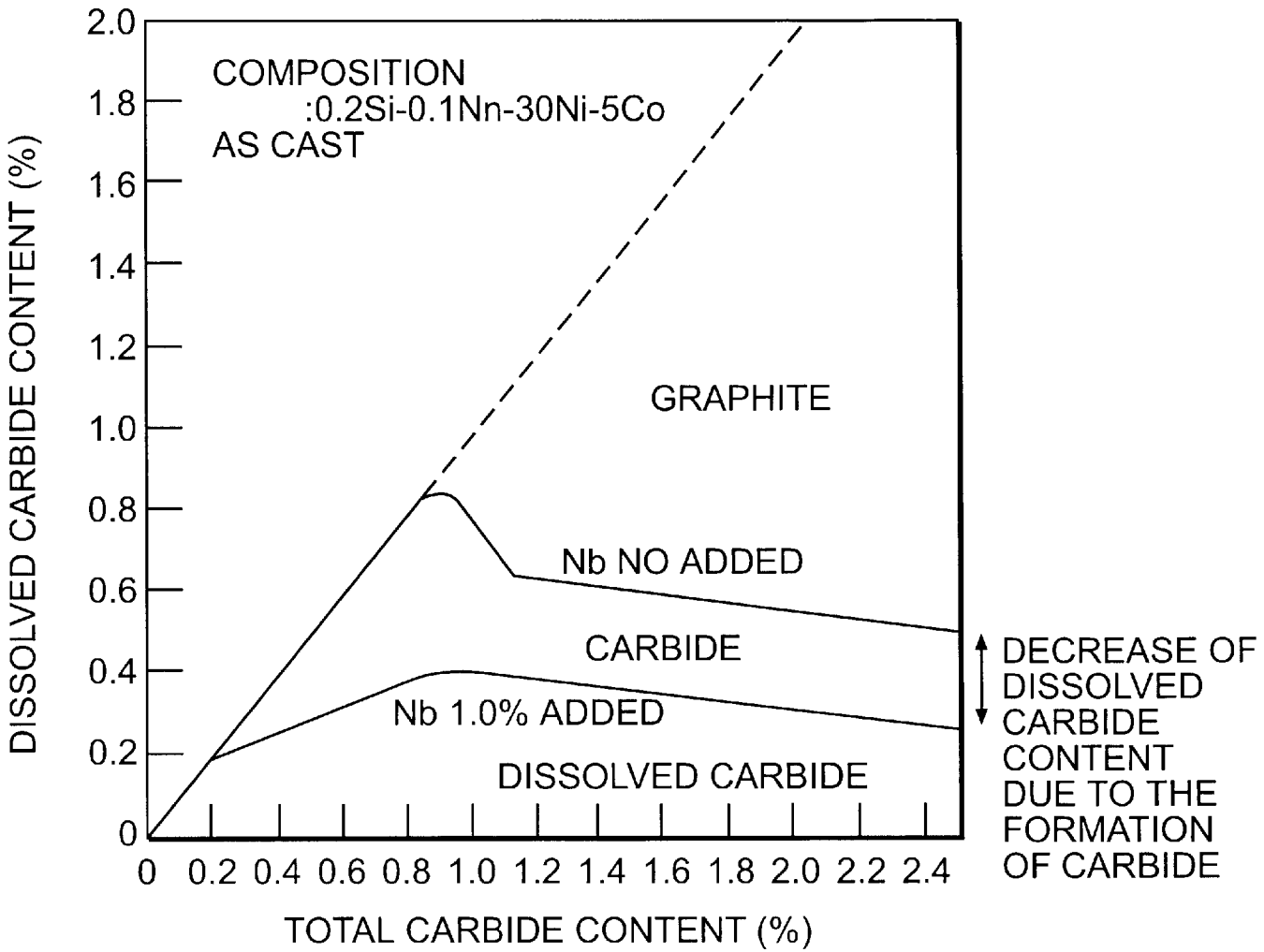
FIG. 8 is a diagram showing the relation between the total carbon content and the dissolved carbon content as found in a low-expansion cast iron in one working example of this invention.

This example concerned a laser oscillator grade rod according to this invention. FIG. 5 is a schematic diagram showing the construction of a laser oscillator using the rod of this invention. In the diagram, 1 stands for an oscillation tube (quartz tube), 2 for an outlet mirror, 3 for a rear mirror, 4 for a heat exchanger, and 5 for a rod. FIG. 6 is an explanatory diagram showing a process for casting the rod mentioned above. The laser oscillator grade rods are parts for determining the length of a resonator which directly bears on the control of the frequency of a laser. The relation between the frequency f of the laser and the length L of the resonator is expressed by the following formula: $f=nC/2L$.

In the formula, f stands for frequency, n for an integer, C for speed of light, and L for length of the resonator. The variation $\Delta L$ of the length of the resonator, therefore, depends on the variation $\Delta f$ of the frequency of the laser in the relation of the following formula: $\Delta f/f=\Delta L/L$ For the purpose of keeping the variable $\Delta f$ of the frequency of the laser at a low level (below some hundreds of nm), it is necessary that the variable $\Delta L$ of the length L of the resonator be repressed to a low level. The rod of an oscillator is a part for fixing the length of the resonator. For the sake of permitting control of the change of temperature, the rod is formed of a hollow pipe so constructed as to be cooled with water. The laser oscillator grade rod constructed as described above was produced by melting cast iron of the same composition as used in Example 16 in the same high-frequency electric furnace and casting the melt by the use of a core 7 necessary for a hollow space and a mold 6 as shown in FIG. 6. The rod 5 of a length practically equal to the length L of the resonator measured about 1000 mm in length, 40 mm in outside diameter, and 20 mm in inside diameter and excelled in castability and in cuttability and workability as well. The hole in this rod 5 was formed by means of a cast borer using the core 6 shown in FIG. 6 and finished by cutting. As a result, the rod obtained as cast attained thermal expansion coefficient of $1.0\times10^{-6}/°$ C. at temperatures in the range of from room temperature to 100° C. It, therefore, could avoid forming deformation and residual stress due to a heat treatment. Since this rod possessed high rigidity, it could repress the deflection below 0.1 mm. By the adoption of the laser oscillator grade rod of this invention constructed as described above, the ratio of variation $\Delta f/f$ of the resonator could be stabilized to the order of $1\times10^{-6}$ because the variation of temperature could be controlled to within 1° C.

Industrial Applicability

As described above, the method of this invention for the production of a high-strength low-expansion cast iron allows manufacture of cast iron possessing improved strength, hardness, and cutting workability while retaining the property of low expansion intact. This invention, therefore, permits provision of cast iron adapted for machine parts which necessitate the property of low expansion and require the ability to retain shape and resist abrasion. Further, the polishing surface plate contemplated by this invention is such that the polishing surface plate having a large size and using high-strength low-expansion cast iron of this invention can be produced exclusively by casting without requiring any heat treatment. As respects the laser oscillator grade rod, the rod produced by using high-strength low-expansion cast iron of this invention is allowed to attain low thermal expansion coefficient and high rigidity without requiring any heat treatment and repress the ratio of variation of the frequency of a resonator to a low level.

In addition to the silicon wafer polishing surface plate and the laser oscillator grade rod mentioned above, the high-strength low-expansion cast iron of this invention can be adapted for various applications making use of property of low expansion, strength, hardness, and cutting workability such as, for example, laser grade spherical polishing surface plate, metal die for CFRP parabolic antenna, stand for laser oscillator, stand for long-distance transmission of laser, laser reflecting plate, optical part holder, solder printer roller, microgauge, and other similar precision mechanical parts.

TABLE 1-1

| | Alloy Composition (weight %) | | | | | |
|---|---|---|---|---|---|---|
| | C | Si | Mn | Ni | Co | Fe |
| 1. Inver | — | — | — | 34–36 | — | Balance |
| 2. Sper Inver | — | — | — | 30–33 | 4–6 | Balance |
| 3. Niresist D5 | ≦2.4 | 1.0–2.8 | ≦1.0 | 34–36 | — | Balance |
| 4. Nobinite Cast Iron (JP-A-60-51547) | 0.8–3.0 | 1.0–3.0 | 0.4–2.0 | 30–33 | 4–6 | Balance |
| 5. Cast Iron (JP-A-62-268249) | 1.0–3.5 | ≦1.5 | ≦1.5 | 32–39.5 | 1.0–4.0 | Balance |

TABLE 1-2

| | | Thermal Extension Coefficience (0–100° C.) × $10^{-6}$/° C. | Tensile Strength kgf/mm$^2$ | Hardness HB |
|---|---|---|---|---|
| 1. | Inver | 1.5 | 40–45 | 120 |
| 2. | Super Inver | 0.5 | 40–45 | 120 |
| 3. | Niresist D5 | 5 | 40–45 | 120 |
| 4. | Nobimite Cast Iron | 4 | 40–45 | 120 |
| 5. | JP-A-62-268249 | 2 | 45–55 | 120 |

TABLE 2-1

| | Component *1 (weight %) | | | | | | |
|---|---|---|---|---|---|---|---|
| | C | Si | Mn | Ni | Co | Mg + ca | Carbide-forming element |
| | | | | Example | | | |
| 1 | 0.3 | 0.2 | 0.1 | 29.0 | 4.6 | 0 | Ti 0.6 |
| 2 | 0.8 | 0.2 | 0.1 | 29.5 | 4.5 | 0.03 | Nb 1.0 |
| 3 | 1.2 | 0.4 | 0.1 | 28.7 | 5.4 | 0.05 | Ta 2.0 |
| 4 | 1.0 | 0.8 | 0.1 | 36.0 | 0 | 0.07 | Nb 1.0, Zr 0.5 |
| 5 | 1.4 | 0.3 | 0 | 33.5 | 2.5 | 0.05 | V 2.3 |
| 6 | 1.5 | 0.3 | 0 | 28.5 | 5.6 | 0.05 | Nb 1.5, Hf 0.1 |
| 7 | 0.9 | 0.5 | 0.2 | 38.5 | 0 | 0.04 | W 0.3, Mo 0.3 |
| 8 | 1.5 | 0.3 | 0.2 | 29.5 | 4.0 | 0.04 | Cr 3.5 |
| 9 | 2.0 | 0.8 | 0.5 | 30.3 | 4.8 | 0.05 | Nb 5.3 |
| 10 | 2.0 | 0.8 | 0.4 | 29.6 | 5.2 | 0.05 | Ti 0.2, Nb 0.2, Ta 0.2, Zr 0.4, V 0.5, Hf 0.2, |
| 11 | 2.4 | 1.1 | 0.9 | 29.6 | 4.3 | 0.04 | Nb 1.4 |
| 12 | 1.2 | 0.2 | 0.2 | 25.0 | 11.0 | 0.04 | Ti 0.5, Nb 0.5 |
| 13 | 0.3 | 0.2 | 0.1 | 29.0 | 4.6 | 0 | Ti 0.6, |
| 14 | 0.8 | 0.2 | 0.1 | 29.5 | 4.5 | 0.03 | Nb 1.0 |
| 15 | 1.2 | 0.2 | 0.2 | 25.0 | 11.0 | 0.04 | Ti 0.5, Nb 0.5 |
| | | | | Comparative Example | | | |
| 1 | 0.8 | 0.2 | 0.1 | 29.5 | 5.0 | 0.04 | — |
| 2 | 2.0 | 0.8 | 1.5 | 31.0 | 4.5 | 0.04 | — |
| 3 | 2.5 | 0.3 | 0.5 | 30.1 | 5.0 | 0.04 | Ti 1.0, V 3.0, W 2.0 Mo 1.0 |
| 4 | 1.5 | 0.4 | 1.2 | 23.0 | 4.8 | 0.05 | Ti 1.0, Nb 1.0 |
| 5 | 3.0 | 1.5 | 1.0 | 30.0 | 3.0 | — | Nb 0.02, V 0.2 |
| 6 | 3.0 | 1.0 | 1.0 | 30.0 | 3.0 | 0.05 | Ti 0.02, V 0.2 |
| 7 | 0.8 | 1.2 | 0.2 | 28.5 | 14.0 | 0.05 | Nb 0.4 |
| 8 | 0.8 | 0.7 | 0.4 | 32.0 | 4.9 | 0.04 | Nb 0.7, Cr 0.7 |
| 9 | 2.25 | 2.2 | 0.1 | 31.9 | 4.6 | 0.02 | Ti 0.1, Cr 0.03 |
| 10 | 2.05 | 1.9 | 0.3 | 36.5 | 0 | 0.02 | Ti 0.13, Cr 0.3 |

*1: The rest is Fe, which includes inevitable impurities.

TABLE 2-2

| | Heat Treatment | Thermal Expansion Coefficient × $10^{-6}$/° C. | Tensile Strength kg/mm$^2$ | Young's Modulus kg/mm$^2$ | Hardness HB | Area Ratio of Carbide Precipitation % | Dissolved Corbon Content Wt. % |
|---|---|---|---|---|---|---|---|
| | | | | Example | | | |
| 1 | No | 1.7 | 57 | 16000 | 280 | 0.5 | 0.22 |
| 2 | No | 2.3 | 72 | 17000 | 320 | 2.0 | 0.40 |
| 3 | No | 0.9 | 70 | 16200 | 300 | 3.0 | 0.15 |
| 4 | No | 1.4 | 72 | 16800 | 300 | 2.0 | 0.20 |
| 5 | No | 2.3 | 65 | 16500 | 296 | 2.0 | 0.38 |
| 6 | No | 2.0 | 62 | 15400 | 288 | 2.5 | 0.36 |
| 7 | No | 1.9 | 80 | 16000 | 330 | 1.0 | 0.25 |
| 8 | No | 1.5 | 75 | 16000 | 360 | 3.5 | 0.21 |
| 9 | No | 6.2 | 70 | 16000 | 360 | 4.0 | 0.40 |
| 10 | No | 5.9 | 64 | 16400 | 420 | 15.0 | 0.39 |
| 11 | No | 5.7 | 67 | 16500 | 300 | 2.0 | 0.36 |
| 12 | No | 7.0 | 65 | 15800 | 300 | 1.6 | 0.40 |
| 13 | Yes | 0.8 | 64 | 15900 | 280 | 0.7 | 0.19 |
| 14 | Yes | 0.9 | 75 | 16200 | 300 | 2.2 | 0.16 |
| 15 | Yes | 0.6 | 69 | 16000 | 300 | 3.4 | 0.14 |
| | | | | Comparative Example | | | |
| 1 | No | 1.2 | 45 | 16000 | 170 | 0 | 0.47 |
| 2 | No | 7.4 | 42 | 16000 | 186 | 0.2 | 0.52 |
| 3 | No | 13.0 | 62 | 17000 | 500 | 21 | 0.15 |
| 4 | No | 8.5 | 65 | 15300 | 300 | 3.6 | 0.25 |
| 5 | No | 2.0 | 35 | 14000 | 130 | 0 | 0.42 |
| 6 | Yes | 7.0 | 32 | 12000 | 200 | 0 | 0.35 |
| 7 | No | 12.0 | 65 | 14000 | 320 | 0 | 0.38 |
| 8 | Yes | 2.8 | 50 | 13600 | 240 | 0 | 0.45 |
| 9 | No | 5.0 | 32 | 11500 | 132 | 0 | 0.49 |
| 10 | No | 4.4 | 35 | 12300 | 125 | 0 | 0.52 |

Note 1:
Example 13, 14, 15, and Comparative Example 6 and 7 used the heat treatment material. (The temperature of solution heat treatment is 850° C.)
Note 2:
Comparative Example 8 used the heat treatment material. (The temperature of solution heat treatment is 950° C.)

TABLE 3

| Example 16 Component (weight %) | | | | | | | | |
|---|---|---|---|---|---|---|---|---|
| C | Si | Mn | Ni | Co | Mg | Ti | Nb | Fe |
| 1.2 | 0.2 | 0.1 | 29.5 | 4.6 | 0.05 | 0.3 | 0.4 | Balance |

| Properties of cast Products | | | | | |
|---|---|---|---|---|---|
| Heat Treatment | Thermal Extension Coefficient × $10^{-6}$/° C. | Tensile Strength kgf/mm$^2$ | Young's Modulus kgf/mm$^2$ | Hardness HB | Area Ratio of Carbide Precipitation % |
| No | 1.0 | 70 | 16000 | 300 | 2.5 |
| Yes | 0.7 | 66 | 15800 | 280 | 2.8 |

Note:
Fe includes inevitable impurities.

What is claimed is:

1. A method for the production of low-expansion cast iron of a high Ni content exhibiting a coefficient of thermal expansion of not more than $8\times10^{-6}$/° C. at temperatures in the range of from room temperature to 100° C., comprising the steps of preparing a material consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and the balance of Fe and other inevitable impurities, melting said material, and casting the melt in a mold of a stated shape, and enabling said carbide-forming element, while said melt is being solidified in said mold, to be finely dispersed and precipitated in a base matrix in the form of carbide particles at an area ratio in the range of from 0.3% to 20% in the metal structure, simultaneously with graphite.

2. The method according to claim 1, wherein said material for cast iron further comprises not more than 1.2% by weight of Si and not more than 1.0% by weight of Mn.

3. The method according to claim 1, wherein said carbide-forming element is at least one member selected from the group consisting of the transition metal elements of IVa, Va, and VIa Groups in the Periodic Table of the Elements.

4. The method according to claim 1, wherein the step of heat treatment after the step of casting is not included.

5. A method for the production of low-expansion cast iron of a high Ni content exhibiting a coefficient of thermal expansion of not more than $8\times10^{-6}/°$ C. at temperatures in the range of from room temperature to 100° C., comprising the steps of preparing a material consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and the balance of Fe and other inevitable impurities, melting said material, and casting the melt in a mold of a stated shape, and enabling said carbide-forming element, while said melt is being solidified in the mold, to be finely dispersed and precipitated in a base matrix in the form of carbide particles in the metal structure thereby lowering the content of dissolved carbon in said cast iron to not more than 0.4% by weight.

6. The method according to claim 5, wherein said material for cast iron further comprises not more than 1.2% by weight of Si and not more than 1.0% by weight of Mn.

7. The method according to claim 5, wherein said carbide-forming element is at least one member selected from the group consisting of the transition metal elements of IVa, Va, and VIa Groups in the Periodic Table of the Elements.

8. The method according to claim 5, wherein graphite is simultaneously dispersed with said carbide in said metal structure.

9. The method according to claim 5, wherein not less than 75% of the amount of said carbide-forming element incorporated is precipitated in the form of a carbide in said metal structure of cast iron.

10. The method according to claim 5, wherein the step of heat treatment after the step of casting is not included.

11. A method for the production of a high-strength low-expansion cast iron, comprising the steps of preparing a material for cast iron consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and He balance of Fe and other inevitable impurities, melting said material, enabling said carbide-forming element, while said melt is being cast and solidified, to be finely dispersed and precipitated in a base matrix as carbide particles in the metal structure of cast iron and, at the same time, lowering the dissolved carbon content contained in the cast iron and giving rise to cast iron exhibiting a coefficient of thermal expansion of not more than $8\times10^{-6}/°$ C. at temperatures in the range of from room temperature to 100° C. and tensile strength of not less than 55 $kgf/mm^2$.

12. The method according to claim 11, wherein said cast iron has hardness of not less than HB 200.

13. The method according to claim 11, wherein said material for cast iron further comprises not more than 1.2% by weight of Si and not more than 1.0% by weight of Mn.

14. The method according to claim 11, wherein said carbide-forming element is at least one member selected from the group consisting of the transition metal elements of IVa, Va, and VIa Groups in the Periodic Table of the Elements.

15. The method according to claim 11, wherein the content of said carbide is in the range of from 0.3% to 20% in terms of area ratio in said metal structure.

16. The method according to claim 11, wherein the amount of dissolved carbon contained in said cast iron is not more than 0.4% by weight.

17. The method according to claim 11, wherein the step of heat treatment after the step of casting is not included.

18. A method for the production of a polishing surface plate of high-strength low-expansion cast iron, comprising the steps of preparing a material for cast iron consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1% by weight to not more than 6.0% by weight of a carbide-forming element, and the balance of Fe and other inevitable impurities, melting said material, enabling said carbide-forming element, while said melt is being cast and solidified, to be finely dispersed and precipitated in a base matrix as carbide particles in an area ratio in the range of from 0.3% to 20% in the metal structure of cast iron.

19. The method according to claim 18, wherein said material for cast iron further comprises not more than 1.2% by weight of Si and not more than 1.0% by weight of Mn.

20. The method according to claim 18, wherein said carbide-forming element is at least one member selected from the group consisting of the transition metal elements of IVa, Va, and VIa Groups in the Periodic Table of the Elements.

21. The method according to claim 18, wherein said polishing surface plate has a diameter of not less than 600 mm.

22. The method according to claim 18, wherein the step of heat treatment after the step of casting is not included.

23. The method according to claim 18, wherein the amount of dissolved carbon contained in said metal structure of cast iron is not more than 0.4% by weight.

24. The method according to claim 18, wherein said cast iron exhibits a coefficient of thermal expansion of not more than $8\times10^{-6}/°$ C. and tensile strength of not less than 55 $kgf/mm^2$.

25. A method for the production of a laser oscillator grade rod, comprising the steps of preparing a material for cast iron consisting of not less than 0.3% by weight to not more than 2.5% by weight of C, not more than 0.1% by weight of Mg or Ca, not less than 25% by weight to not more than 40% by weight of Ni, less than 12% by weight of Co, not less than 0.1 by weight to not more than 6.0% by weight of a carbide-forming element, and the balance of Fe and other inevitable impurities, melting said material, enabling said carbide-forming element, while said melt is being cast and solidified, to be finely dispersed and precipitated in a base matrix as carbide particles in an area ratio in the range of from 0.3% to 20% in the metal structure of cast iron.

26. The method according to claim 25, wherein said material for cast iron further comprises not more than 1.2% by weight of Si and not more than 1.0% by weight of Mn.

27. The method according to claim 25, wherein said carbide-forming element is at least one member selected from the group consisting of the transition metal elements of IVa, Va, and VIa Groups in the Periodic Table of the Elements.

28. The method according to claim 25, wherein the step of heat treatment after the step of casting is not included.

29. The method according to claim 25, wherein the amount of dissolved carbon contained in said metal structure of cast iron is not more than 0.4% by weight.

30. The method according to claim 25, wherein said cast iron exhibits a coefficient of thermal expansion of not more than $8\times10^{-6}/°$ C. and tensile strength of not less than 55 $kgf/mm^2$.

31. The method according to claim 1, wherein the grain Size of said carbide particles in the metal structure is not more than 10 $\mu$m.

32. The method according to claim 5, wherein the grain size of said carbide particles in the metal structure is not more than 10 $\mu$m.

33. The method according to claim 11, wherein the grain size of said carbide particles in the metal structure is not more than 10 $\mu$m.

34. The method according to claim 20, wherein the grain size of said carbide particles in the metal structure is not more than 10 $\mu$m.

35. The method according to claim 25, wherein the grain size of said carbide particles in the metal structure is not more than 10 $\mu$m.

* * * * *

UNITED STATES PATENT AND TRADEMARK OFFICE

CERTIFICATE OF CORRECTION

PATENT NO. : 6,110,305
DATED : August 29, 2000
INVENTOR(S) : Nishimura et al.

It is certified that error appears in the above-identified patent and that said Letters Patent is hereby corrected as shown below:

Column 19, claim 3,
Lines 13-14, change "the transition metal elements of IVa, Va, and VIa Groups in the Periodic Table of Elements" to -- Nb, Ta, Ti, Zr, and Hf --.

Column 19, claim 7,
Lines 39-40, change "the transition metal elements of Iva, Va, and VIa Groups in the Periodic Table of Elements" to -- Nb, Ta, Ti, Zr, and Hf --.

Column 19, claim 8,
Line 42, change "carbide" to -- carbide particles --.

Column 19, claim 9,
Line 46, after "precipitated" insert -- and finely dispersed --; and
change "a carbide" to -- carbide particles --.

Column 19, claim 11,
Line 57, change "He" to -- the --.

Column 20, claim 14,
Lines 8-10, change "the transition metal elements of IVa, Va, and VIa, Groups in the Periodic Table of Elements" to -- Nb, Ta, Ti Zr, and Hf --.

Column 20, claim 15,
Line 12, change "carbide" to -- carbide particles --.

Column 20, claim 20,
Lines 37-39, change " the transition metal elements of IVa, Va, and VIa Groups in the Periodic Table of Elements" to -- Nb, Ta, Ti, Zr, and Hf --.

Column 21, claim 27,
Lines 3-5, change "the transition metal elements of IVa, Va, and VIa Groups in the Periodic Table of Elements" to -- Nb, Ta, Ti, Zr, and Hf --.

UNITED STATES PATENT AND TRADEMARK OFFICE

CERTIFICATE OF CORRECTION

PATENT NO. : 6,110,305
DATED : August 29, 2000
INVENTOR(S) : Nishimura et al.

It is certified that error appears in the above-identified patent and that said Letters Patent is hereby corrected as shown below:

Column 21, claim 21,
Line 16, change "Size" to -- size --.

Column 22, claim 34,
Line 8, change "claim 20" to -- claim 18 --.

Signed and Sealed this

Twelfth Day of February, 2002

*Attest:*

*Attesting Officer*

JAMES E. ROGAN
*Director of the United States Patent and Trademark Office*